US006024022A

United States Patent [19]

Toyre

[11] Patent Number: 6,024,022

[45] Date of Patent: Feb. 15, 2000

[54] DISENGAGEABLE CLAMP OF A TRACTION CABLE TYPE CONVEYOR

[76] Inventor: Georges Toyre, 57 rue de Cartale, 38170 Seyssinet-Pariset, France

[21] Appl. No.: 09/000,852

[22] Filed: Dec. 30, 1997

[30] Foreign Application Priority Data

Jan. 6, 1997 [FR] France ..... 97 00163

[51] Int. Cl.[7] ..... B61B 7/00

[52] U.S. Cl. ..... 104/173.1; 104/202; 104/203; 104/209; 104/214; 104/216

[58] Field of Search ..... 104/173.1, 178, 104/202, 203, 209, 214, 216

[56] References Cited

U.S. PATENT DOCUMENTS

| | | | |
|---|---|---|---|
| 4,633,783 | 1/1987 | Feuz | 104/209 |
| 4,653,406 | 3/1987 | Levi | 104/216 |
| 4,686,906 | 8/1987 | Meindl | 104/209 |
| 4,716,838 | 1/1988 | Huon De Kermadec et al. | 104/173.1 |
| 5,111,751 | 5/1992 | Zlotek | 104/209 |
| 5,558,393 | 9/1996 | Hawkins et al. | 267/164 |

FOREIGN PATENT DOCUMENTS

| | | |
|---|---|---|
| 2 591 548-A1 | 6/1987 | France . |
| 1 237 161 | 3/1967 | Germany . |
| WO 83/02095 | 6/1983 | WIPO . |

*Primary Examiner*—Robert J. Oberleitner
*Assistant Examiner*—Robert J. McCarry, Jr.
*Attorney, Agent, or Firm*—Parkhurst & Wendel, L.L.P.

[57] ABSTRACT

A traction cable-type vehicle for a reserved lane conveyor is equipped with a disengageable clamp secured below the vehicle. A mobile jaw of the clamp is designed as an elbow lever mounted in a swiveling manner on a fixed pin, and is arranged above the cable housing between the fixed and mobile jaws of the clamp. The elbow lever cooperates with a toggle lever having a spring-loaded telescopic link and an actuator for extending and folding of the toggle lever to close and open the clamp. The fixed and movable jaws are removable.

7 Claims, 5 Drawing Sheets

DISENGAGEABLE CLAMP OF A TRACTION CABLE TYPE CONVEYOR

The invention relates to a disengageable clamp for coupling a vehicle to a traction cable, extending below the vehicle, of a reserved lane conveyor, comprising a clamp body secured under the bottom of the vehicle, a fixed jaw carried by this body and protruding downwards, a mobile jaw cooperating with the fixed jaw to grip the cable in a coupled position and to allow the disengagement of the cable downwards in an uncoupled position, and a control mechanism having a toggle lever with two links connected by a toggle lever pin, to move the mobile jaw into a position in which the cable is coupled or uncoupled.

The cable traction of vehicles by a reserved lane conveyor has many advantages, simplicity and reliability in particular, but it requires the use of disengageable clamps, to couple and uncouple the vehicle to and from the cable, whose opening and closing are perfectly ensured, so as to avoid the slightest risk of the clamp sliding on the cable and of wrong maneuvers. French patent application no. 2 719 012 describes a clamp of the type mentioned, having a pair of jaws carried by a pin. This clamp cooperates with a cable located below the lane and it is bulky and complex. The goal of the present invention is to make it possible to achieve a reliable clamp having a simple structure, capable of being housed beneath the vehicle and of cooperating with a cable, extending level with or above the lane.

The clamp according to the invention is characterised in that the mobile jaw is mounted in a swivelling manner on a pin parallel to the housing of the cable gripped by the jaws and is rigidly attached to a lever so as to form an elbow lever of the first type, the end of the elbow lever, opposite to the mobile jaw, being hinged to one of the toggle lever links, and in that the other toggle lever link is mounted in a rotatable manner on a fixed pin of the body, parallel to said swivel pin of the elbow lever, so that the elbow lever and said links move about on parallel or identical vertical planes and said toggle lever links are aligned and practically horizontal in the position in which the cable is clamped.

The use of a swivelling mobile jaw, which forms an elbowed control lever, simplifies the structure of the clamp, whose overall dimensions, its height in particular, are reduced through a judicious arrangement of its component parts.

The elbow lever is coupled to a toggle lever, which ensures stable positions in which the clamp is opened and closed, in particular by means of a slight overshooting of the dead point in the closed position. The toggle lever comprises a telescopic link, associated with a compression spring, advantageously consisting of a stack of elastic washers, which exert a tensile stress on the telescopic link. One of the ends of the toggle lever is hinged to a fixed point whereas the opposite end is hinged to the elbow lever. An actuator cooperates with the toggle lever to actuate the opening and closing of the clamp.

According to a significant development of the invention, the jaws are made up of easily removable and exchangeable independent parts, the same clamp possibly being equipped with different types of jaws, in particular for cables with different cross-sections.

Further advantages and characteristics will be more clearly understood upon reading the description which follows of a mode of implementation of the invention provided as an example and shown in the attached drawings, in which.

DETAILED DESCRIPTION OF THE INVENTION

Figure 1:
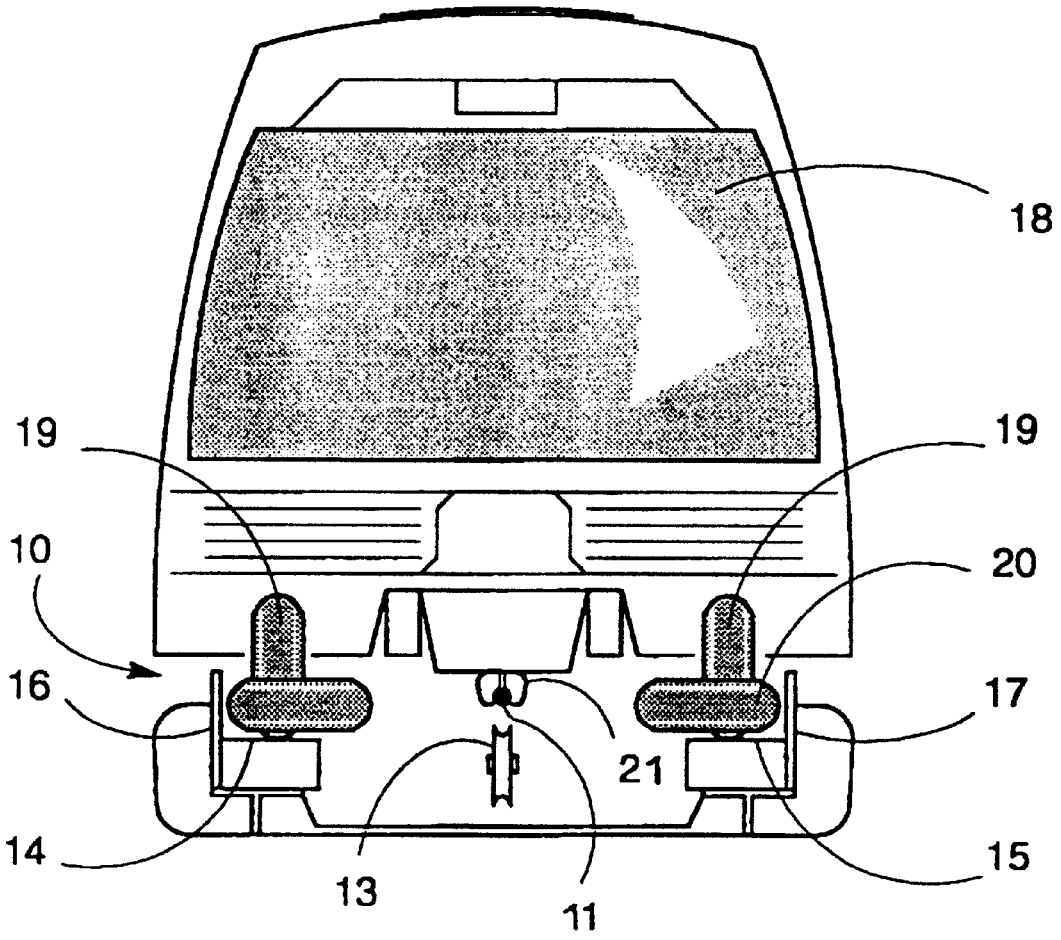
FIG. 1 is a schematic view of a vehicle equipped with a clamp according to the invention.

In the figures, a reserved lane 10 consists of two runways 14, 15, each one being associated with a guideway 16, 17. The vehicles 18 running on the lane 10 are equipped with runner wheels 19 and guiding wheels 20, which cooperate with the runways 14, 15 and guideways 16, 17, respectively. These wheels 19, 20 are of pneumatic tyre type, but it is clear that the invention is applicable to a railway and to vehicles of any other type. A traction cable 11 extends along the axis and above the lane 10, guided by supporting pulleys 13 and driven by an engine (not shown). A clamp 21 is secured to the bottom of the vehicle 18, capable of gripping the cable 11 to couple the vehicle to this traction cable.

The clamp 21 includes a fixed jaw 22 and a mobile jaw 23, carried by a clamp body 24 secured under the bottom of the vehicle 18, so that the pair of jaws 22, 23 protrudes downwards and allows for the engagement of the cable 11 between the jaws 22, 23 and for its disengagement through a relative up and down motion. The mobile jaw 23 is pivoted on a fixed pin 25, integral with the clamp body 24 and arranged above the housing of the cable 11, confined by the jaws 22, 23 in the coupled position. The mobile jaw 23 is integral with and prolonged by a lever forming an elbow control lever 26. The end 27 of the elbow lever 26, opposite to the mobile jaw 23, is hinged to a first link 28 of a toggle lever 29, whose second link 30 mounted in a rotatable manner on a fixed pin 31. The first link 28 is made up of two telescopic parts, between which a compression spring 32 is inserted, the latter consisting, for example, of a stack of elastic washers which exert a tensile stress on the link 28. The stroke of the extension of the telescopic link 28 and therefore of the expansion of the spring 32, is limited by stoppers 12. The two links 28, 30 are connected by the pin 33 of the toggle lever 29, which, in the position in which the toggle lever 29 is extended and overshoots the dead point, cooperates with a fixed stopper 34. In this extended position, the toggle lever 29 is substantially horizontal above the hinge pin 25 of the elbow lever 26. The second link 30 carries a transversal arm 35, to which the rod 36 of an actuator 37, hydraulic or pneumatic, for example, is hinged, to actuate the extension or folding of the toggle lever 29. In the example illustrated by FIGS. 4 to 6, the elbow lever 26, the second link 30 and the actuator 37 are divided into two so as to form a symmetrical assembly with a high reliability of operation. It is clear that each of the links 28, 30 may include a spring 32.

Figure 2:
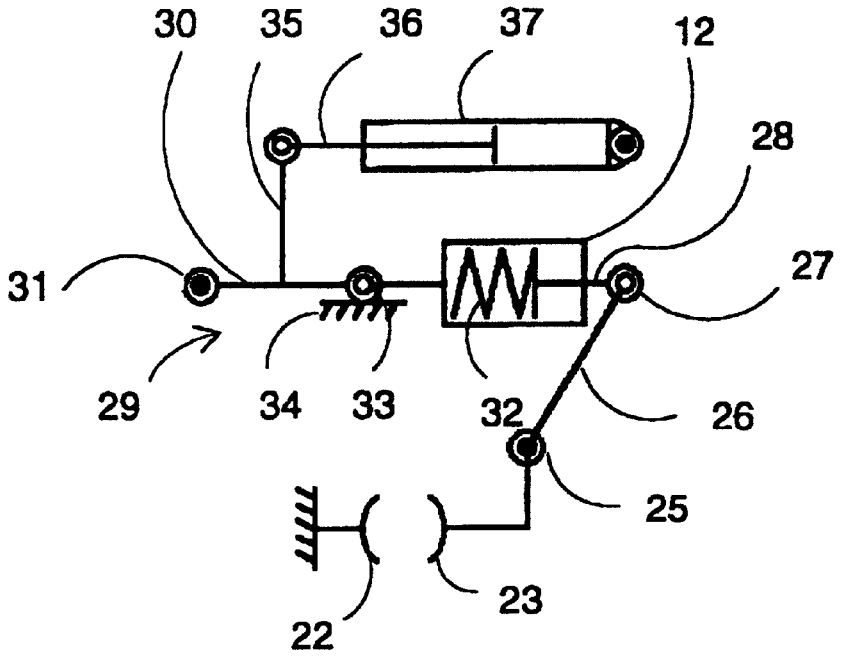
FIGS. 2 and 3 are schematic illustrations of the clamp according to FIG. 1, shown in the closed and open position, respectively.
Figure 3:
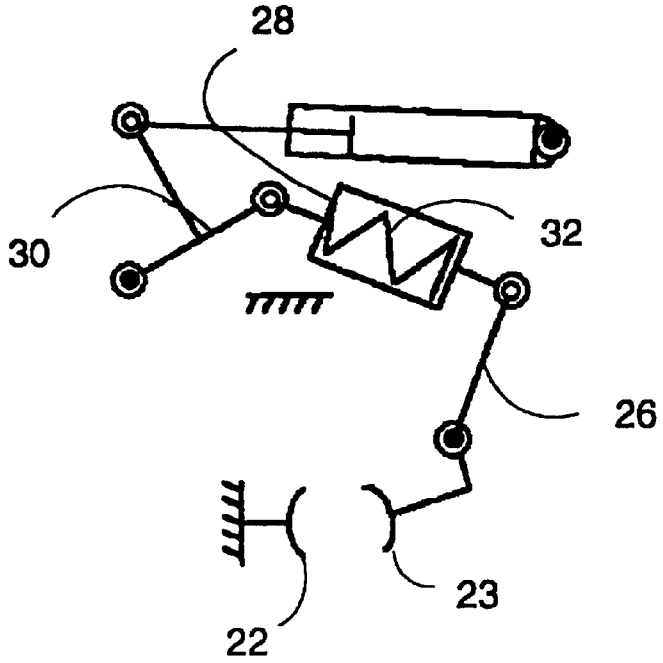
Figure 4:
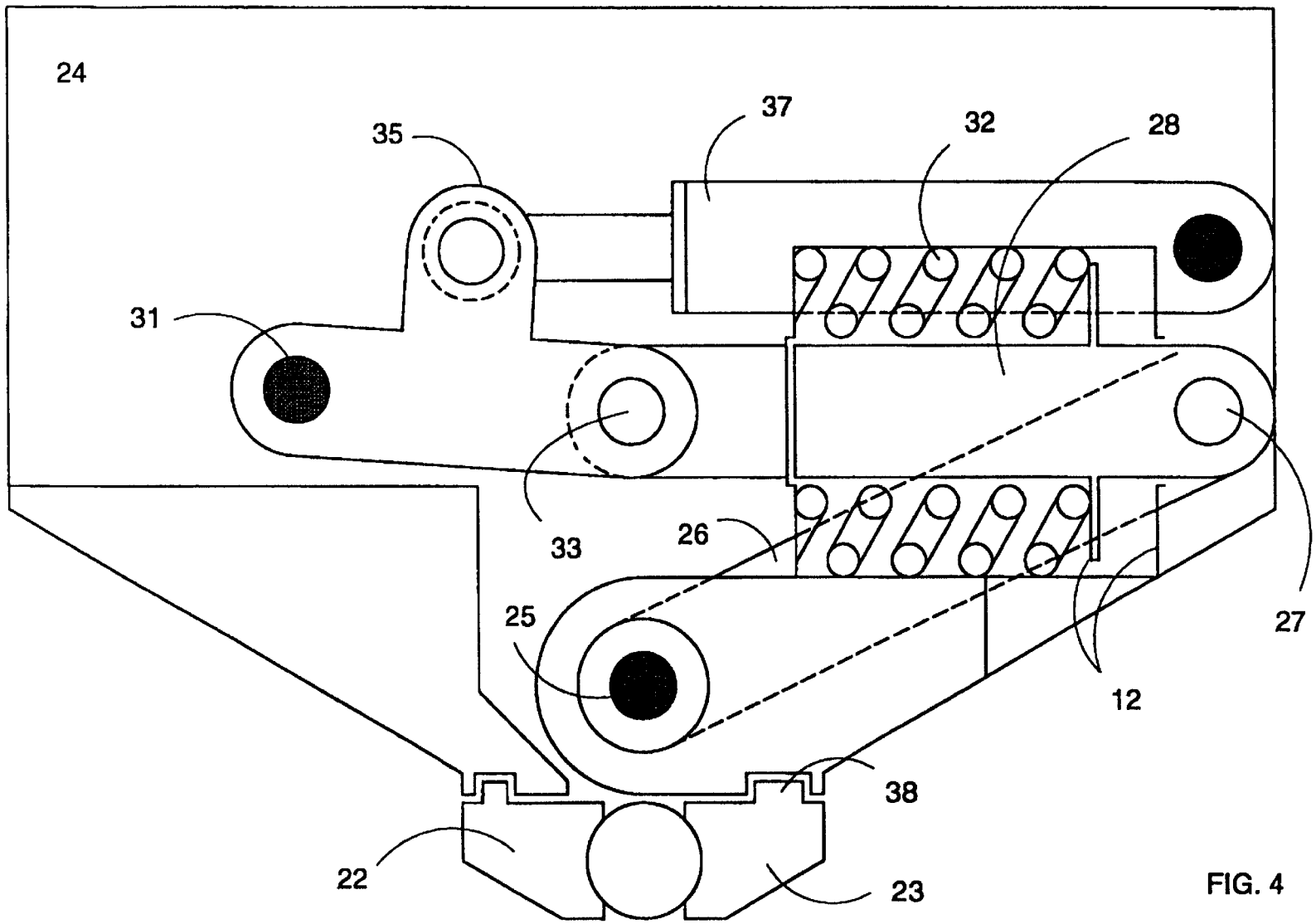
FIGS. 4 and 5 are axial sectional views of the clamp, shown in the closed and open position, respectively.
Figure 5:
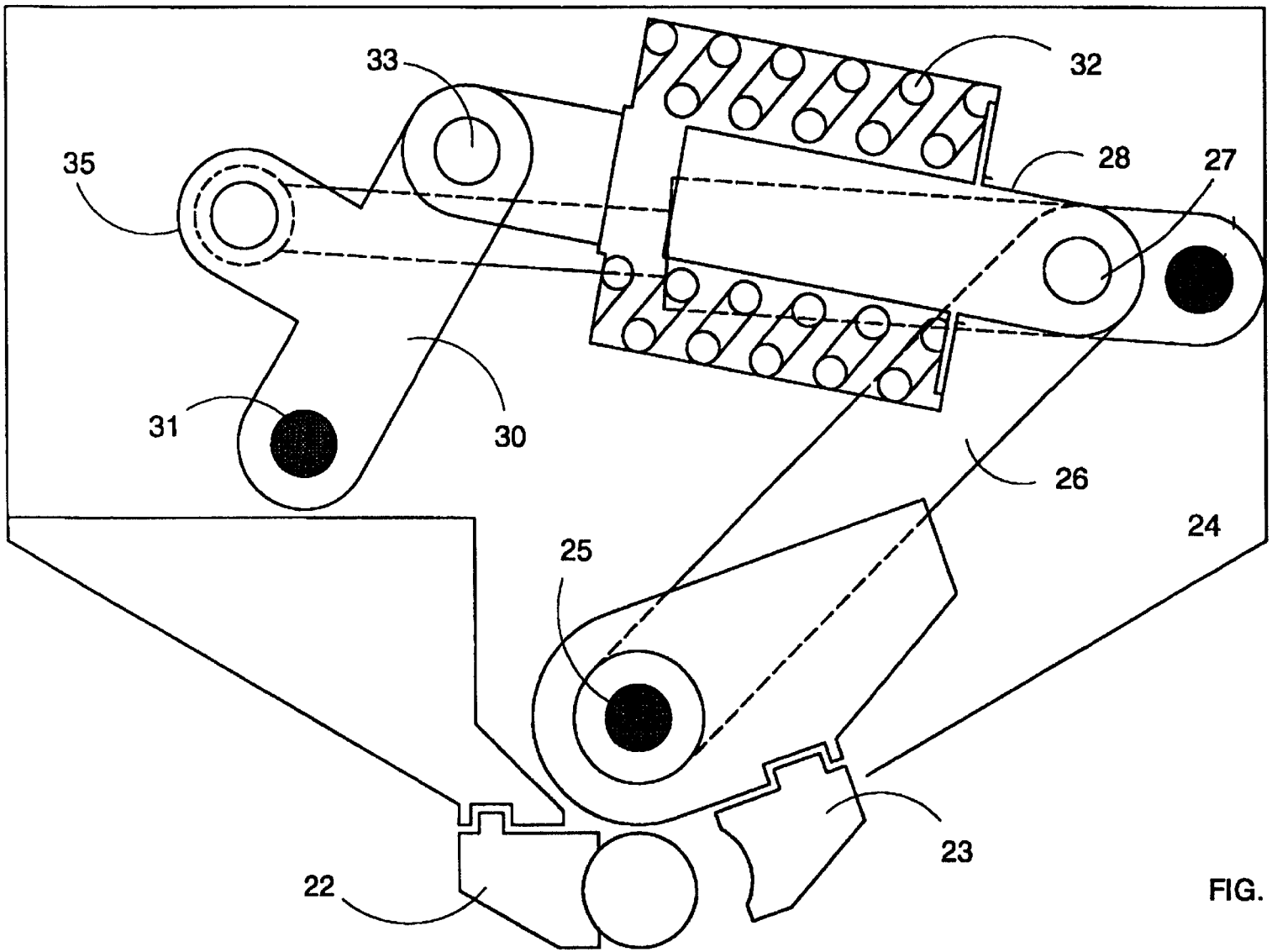
Figure 6:
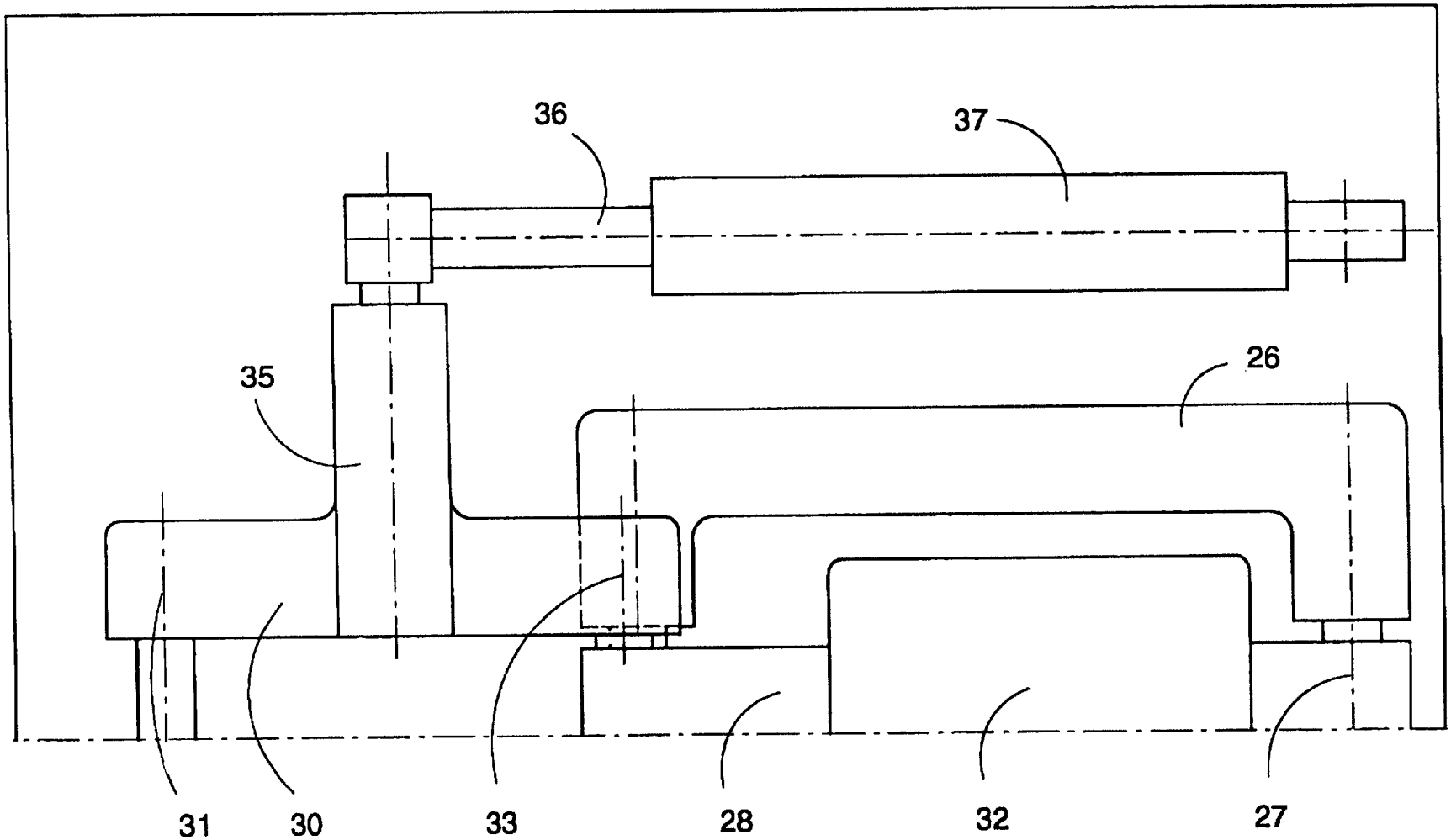
FIG. 6 is a top half view of the clamp, shown in the closed position.

The assembly is arranged in such a manner that in the position in which the toggle lever 29 is extended, shown in FIGS. 2, 4 and 6, the jaws 22, 23 grip the cable 11 with a clamping force corresponding to that of the spring 32, multiplied by the ratio of the arms of the elbow lever 26. The dead point of the toggle lever 29 is slightly overshot and this extended position is therefore a stable position in which the clamp 21 is closed. The opening of the clamp 21 is actuated by the actuator 37, which swivels the second link 30 in the counter-clockwise direction in FIG. 2, thus bringing about the folding of the toggle lever 29 and the swivelling of the elbow lever 26 in the counter-clockwise direction. The mobile jaw 23 is moved towards the open position of the jaws 22, 23, shown in FIG. 3. As soon as the dead point is exceeded, the spring 32 contributes to the folding of the toggle lever 29 and the open position is also stable. Of course, an inverse supply of the actuator 37 actuates the closing of the clamp 21. It should be noted that during an initial period, corresponding to the phase during which the mobile jaw 23 moves towards the cable 11, the spring 32 remains in expanded position and the only force to be overcome by the actuator 37 is the frictional force. As soon as the jaw 23 rests against the cable 11, the movement performed by the actuator 37 brings about a shortening of the first link 28 and a compression of the spring 32, and the actuating force quickly increases.

The mobile jaw 23 and the fixed jaw 22 are independent parts secured to the elbow lever 26 and to the clamp body 24 in a removable manner, for example, with centering lugs 38 and screws (not shown), respectively. When worn, the jaws 22, 23 can thus be easily replaced with new jaws and the same clamp may be used for cables with different cross-sections by choosing appropriate jaws.

Of course, the invention is by no means limited to the mode of implementation specifically described with reference to the drawings and it applies to any alternate embodiment remaining within the scope of equivalencies.

I claim:

1. A disengageable clamp for coupling a vehicle to a traction cable extending below the vehicle for a reserved lane conveyor, comprising:

a clamp body secured under the vehicle, a fixed jaw carried by the body and protruding downwardly, a mobile jaw cooperating with the fixed jaw to grip a cable in a coupled position and to allow disengagement of the cable downwardly to an uncoupled position, and a control mechanism having a toggle lever with a plurality of toggle lever links connected by a toggle lever pin to move the mobile jaw into a position in which the cable is coupled or uncoupled, wherein the mobile jaw is mounted in a swiveling manner on a swivel pin parallel to the cable and is rigidly attached to an elbow control lever to form an elbow lever, wherein an end of the elbow lever opposite to the mobile jaw is hinged to one of the toggle lever links, and another one of the toggle lever links is mounted in a rotatable manner on a fixed pin parallel to said swivel pin so that the elbow lever and said toggle lever links are arranged to move about parallel or identical vertical planes, and said toggle lever links are aligned and substantially horizontal when the cable is clamped.

2. A clamp according to claim 1, wherein one of the toggle lever links is a telescopic link having a spring forcing the telescopic link to an extended position to clamp the cable.

3. A clamp according to claim 2, wherein said spring is a compression spring comprising a plurality of elastic washers attached to the telescopic link.

4. A clamp according to claim 1, wherein when the cable is clamped, the toggle lever is in a stable position wherein a dead point of the toggle lever is overshot, and the toggle lever pin lies above the swivel pin of the elbow lever.

5. A clamp according to claim 1, wherein the control mechanism includes an actuator coupled to the toggle lever link mounted in a rotatable manner on said fixed pin to extend and fold the toggle lever.

6. A clamp according to claim 1, wherein the jaws comprise independent parts secured in a removable manner.

7. A clamp according to claim 6, wherein the clamp is configured to receive different configurations of jaws for clamping cables of different cross-sections.

* * * * *